US010166808B2

(12) United States Patent
Ritter et al.

(10) Patent No.: US 10,166,808 B2
(45) Date of Patent: Jan. 1, 2019

(54) OPTICALLY VARIABLE SECURITY THREADS AND STRIPES

(71) Applicants: SICPA HOLDING SA, Prilly (CH); CHINA BANKNOTE SICPA SECURITY INK CO., LTD., Beijing (CN)

(72) Inventors: Gebhard Ritter, Lausanne (CH); Pierre Degott, Crissier (CH); Xiang Li, Beijing (CN); Fang Yuan, Beijing (CN)

(73) Assignees: SICPA HOLDING SA, Prilly (CH); CHINA BANKNOTE SICPA SECURITY INK CO., LTD., Beijing (CN)

( * ) Notice: Subject to any disclaimer, the term of this patent is extended or adjusted under 35 U.S.C. 154(b) by 87 days.

(21) Appl. No.: 15/103,553

(22) PCT Filed: Dec. 11, 2013

(86) PCT No.: PCT/CN2013/089050
§ 371 (c)(1),
(2) Date: Jun. 10, 2016

(87) PCT Pub. No.: WO2015/085505
PCT Pub. Date: Jun. 18, 2015

(65) Prior Publication Data
US 2016/0325578 A1 Nov. 10, 2016

(51) Int. Cl.
*B42D 25/355* (2014.01)
*B42D 25/369* (2014.01)
(Continued)

(52) U.S. Cl.
CPC ..... *B42D 25/355* (2014.10); *B42D 25/29* (2014.10); *B42D 25/324* (2014.10);
(Continued)

(58) Field of Classification Search
CPC ... B42D 25/338; B42D 25/355; B42D 25/378
See application file for complete search history.

(56) References Cited

U.S. PATENT DOCUMENTS 964,014 A 7/1910 Gernaert
4,609,207 A 9/1986 Muck et al.
(Continued)

FOREIGN PATENT DOCUMENTS

CN 101905588 12/2010
CN 102179966 9/2011
(Continued)

OTHER PUBLICATIONS

CN 102956147 Translation.*
(Continued)

*Primary Examiner* — Kyle R Grabowski
(74) *Attorney, Agent, or Firm* — Muncy, Geissler, Olds & Lowe, P.C.

(57) ABSTRACT

Optically variable security threads or stripes to be incorporated into or onto security documents, relate to the field of the protection of value documents and value commercial goods against counterfeit and illegal reproduction. The security threads or stripes comprise a) an optically variable layer; b) a color constant layer having a color matching the color impression of the optically variable layer at a viewing angle; c) a holographic metallic layer; and d) and a transparent substrate, wherein the optically variable layer, the color constant layer and the holographic metallic layer are at least partially jointly visible from at least one side of the security thread or stripe.

19 Claims, 4 Drawing Sheets

(51) Int. Cl.

| | |
|---|---|
| ***B42D 25/351*** | (2014.01) |
| ***B42D 25/328*** | (2014.01) |
| ***B42D 25/378*** | (2014.01) |
| ***B42D 25/373*** | (2014.01) |
| ***B42D 25/29*** | (2014.01) |
| ***B42D 25/324*** | (2014.01) |
| ***B42D 25/342*** | (2014.01) |
| ***B42D 25/45*** | (2014.01) |

(52) U.S. Cl.

CPC ..... *B42D 25/328* (2014.10); *B42D 25/342* (2014.10); *B42D 25/351* (2014.10); *B42D 25/369* (2014.10); *B42D 25/373* (2014.10); *B42D 25/378* (2014.10); *B42D 25/45* (2014.10)

(56) References Cited

U.S. PATENT DOCUMENTS

| | | | | |
|---|---|---|---|---|
| 4,652,015 | A | 3/1987 | Crane | |
| 4,705,300 | A | 11/1987 | Berning et al. | |
| 4,705,356 | A | 11/1987 | Berning et al. | |
| 4,721,271 | A | 1/1988 | Goldstein et al. | |
| 4,756,557 | A | 7/1988 | Kaule et al. | |
| 4,838,648 | A | 6/1989 | Phillips et al. | |
| 4,897,300 | A | 1/1990 | Boehm | |
| 5,068,008 | A | 11/1991 | Crane | |
| 5,074,914 | A | 12/1991 | Shirota et al. | |
| 5,084,351 | A | 1/1992 | Phillips et al. | |
| 5,214,530 | A | 5/1993 | Coombs et al. | |
| 5,281,480 | A | 1/1994 | Phillips et al. | |
| 5,324,079 | A | 6/1994 | Kaule et al. | |
| 5,383,995 | A | 1/1995 | Phillips et al. | |
| 5,569,535 | A | 10/1996 | Phillips et al. | |
| 5,571,624 | A | 11/1996 | Phillips et al. | |
| 5,997,622 | A | 12/1999 | Weber et al. | |
| 6,001,161 | A | 12/1999 | Evans et al. | |
| 6,759,097 | B2 | 7/2004 | Phillips et al. | |
| 6,838,166 | B2 | 1/2005 | Phillips et al. | |
| 8,025,952 | B2 | 9/2011 | Raksha et al. | |
| 8,343,615 | B2 | 1/2013 | Raksha et al. | |
| 8,381,988 | B2 | 2/2013 | Lister et al. | |
| 8,534,710 | B2 | 9/2013 | Hoffmuller et al. | |
| 8,733,797 | B2 * | 5/2014 | Heim | B42D 25/00 283/72 |
| 9,007,669 | B2 * | 4/2015 | Heim | G03H 1/0244 283/86 |
| 2007/0241553 | A1 * | 10/2007 | Heim | B42D 25/355 283/91 |
| 2009/0200791 | A1 | 8/2009 | Despland et al. | |
| 2009/0243278 | A1 * | 10/2009 | Camus | B42D 25/355 283/72 |
| 2011/0012337 | A1 | 1/2011 | Heim | |
| 2011/0095518 | A1 * | 4/2011 | Hoffmuller | B42D 25/45 283/85 |
| 2011/0215562 | A1 | 9/2011 | Bleikolm et al. | |
| 2012/0074684 | A1 * | 3/2012 | Marchant | B42D 25/351 283/85 |
| 2012/0168515 | A1 * | 7/2012 | Schutzmann | B42D 25/355 235/488 |
| 2013/0033032 | A1 | 2/2013 | Degott et al. | |
| 2013/0084411 | A1 | 4/2013 | Raksha et al. | |

FOREIGN PATENT DOCUMENTS

| | | |
|---|---|---|
| CN | 102910028 | 2/2013 |
| CN | 102956147 A * | 3/2013 |
| CN | 102956147 | 9/2014 |
| EP | 0021350 | 1/1981 |
| EP | 0185396 | 6/1986 |
| EP | 0303725 | 2/1989 |
| EP | 0319157 | 6/1989 |
| EP | 0518740 | 12/1992 |
| EP | 0608078 | 7/1994 |
| EP | 0686675 | 2/1998 |
| EP | 1498545 | 1/2005 |
| EP | 1666546 | 6/2006 |
| EP | 1710756 | 10/2006 |
| EP | 1819525 | 3/2010 |
| EP | 2165774 | 3/2010 |
| EP | 2263806 | 12/2010 |
| EP | 2263807 | 12/2010 |
| EP | 2306222 | 4/2011 |
| EP | 2325677 | 5/2011 |
| EP | 2402401 | 1/2012 |
| EP | 2465701 | 6/2012 |
| EP | 1878773 | 8/2012 |
| EP | 1674282 | 6/2013 |
| JP | 62190272 | 8/1987 |
| JP | 02080470 | 3/1990 |
| JP | 63218766 | 9/1998 |
| WO | 1990008367 | 7/1990 |
| WO | 1992011142 | 7/1992 |
| WO | 1996004143 | 2/1996 |
| WO | 1996039307 | 12/1996 |
| WO | 1996039685 | 12/1996 |
| WO | 1998019866 | 5/1998 |
| WO | 2001003945 | 1/2001 |
| WO | 2002073250 | 9/2002 |
| WO | 2003000801 | 1/2003 |
| WO | 2004007095 | 1/2004 |
| WO | 2004048120 | 6/2004 |
| WO | 2007042865 | 4/2007 |
| WO | 2007131833 | 11/2007 |
| WO | 2008083894 | 7/2008 |
| WO | 2011092502 | 8/2011 |
| WO | 2012104098 | 8/2012 |

OTHER PUBLICATIONS

*Chem. Rev. 99* (1999), G. Pfaff and P. Reynders, pp. 1963-1981.

*Chemistry & Technology of UV & EB Formulation for Coatings, Inks & Paints*, published in 7 volumes in 1997-1998 by John Wiley & Sons in association with SITA Technology Limited.

Crivello et al., "Photoinitiators for Free Radical Cationic and Anionic Polymerization", 2nd edition, *Chemistry & Technology of UV & EB Formulation for Coatings, Inks & Paints*, vol. III, edited by G. Bradley and published in 1998 by John Wiley & Sons in association with SITA Technology Limited.

*Printing Technology*, J. M. Adams and P. A. Dolin, Delmar Thomson Learning, 5th Edition.

*Handbook of print media*, Helmut Kipphan, Springer Edition, pp. 360-394.

*The Printing ink manual*, R.H. Leach and R.J. Pierce, Springer Edition, 5th Edition, pp. 58-62.

*Printing Technology*, J. M. Adams and P.A. Dolin, Delmar Thomson Learning, 5th Edition, pp. 293-328.

*Printing Technology*, J. M. Adams and P.A. Dolin, Delmar Thomson Learning, 5th Edition, pp. 359-360.

International Search Report, Written Opinion and International Preliminary Report on Patentability issued with respect to application No. PCT/CN2013/089050.

Chinese Office Action and Search Report in counterpart Chinese Application No. 201380081463.9 dated May 11, 2017 (and English Language Translation).

Official communication issued from European Patent Office in counterpart European Application No. EP13898914 dated May 30, 2017.

* cited by examiner

OPTICALLY VARIABLE SECURITY THREADS AND STRIPES

CROSS-REFERENCE TO RELATED APPLICATIONS

The present application is a U.S. National Stage of International Patent Application No. PCT/CN2013/089050 filed Dec. 11, 2013, the disclosure of which is expressly incorporated by reference herein in its entirety.

FIELD OF THE INVENTION

The present invention relates to the field of the protection of value documents and value commercial goods against counterfeit and illegal reproduction. In particular, the present invention relates to optically variable security threads or stripes to be incorporated into or onto security documents, said security threads or stripes exhibiting highly dynamic visual motion effect upon tilting.

BACKGROUND OF THE INVENTION

With the constantly improving quality of color photocopies and printings and in an attempt to protect security documents such as banknotes, value documents or cards, transportation tickets or cards, tax banderols, and product labels against counterfeiting, falsifying or illegal reproduction, it has been the conventional practice to incorporate various security elements in these documents. Typical examples of security elements include security threads or stripes, windows, fibers, planchettes, foils, decals, holograms, watermarks, security inks comprising optically variable pigments, magnetic or magnetizable thin film interference pigments, interference-coated particles, thermochromic pigments, photochromic pigments, luminescent, infrared-absorbing, ultraviolet-absorbing or magnetic compounds.

Security threads embedded in the substrate are known to those skilled in the art as an efficient way for the protection of security documents and banknotes against imitation. Reference is made to U.S. Pat. No. 0,964,014; U.S. Pat. No. 4,652,015; U.S. Pat. No. 5,068,008; U.S. Pat. No. 5,324,079; WO 90/08367 A1; WO 92/11142 A1; WO 96/04143 A1; WO 96/39685 A1; WO 98/19866 A1; EP 0 021 350 A1; EP 0 185 396 A2; EP 0 303 725 A1; EP 0 319 157 A2; EP 0 518 740 A1; EP 0 608 078 A1; and EP 1 498 545 A1 as well as the references cited therein. A security thread is a metal- or plastic-filament, which is incorporated during the manufacturing process into the substrate serving for printing security documents or banknotes. Security threads or stripes carry particular security elements, serving for the public- and/or machine-authentication of the security document, in particular for banknotes. Suitable security elements for such purpose include without limitation metallizations, optically variable compounds, luminescent compounds, micro-texts and magnetic features.

With the aim of protecting value documents such as banknotes from being forged, optically variable security threads or stripe exhibiting color shift or color change upon variation of the angle of observation have been proposed as security features to be incorporated into or onto said value documents. The protection from forgery is based on the variable color effect that optically variable security elements convey to the viewer in dependence on the viewing angle or direction.

US 2007/0241553 discloses security elements for securing valuable articles having an optically variable layer that imparts different color impressions at different viewing angles and, in a covering area, a semi-transparent ink layer disposed on top of the optically variable, the color impression of the optically variable layer being coordinated with the color impression of the semi-transparent ink layer in the covering area when viewed under predefined viewing conditions.

WO 2007/042865 A1 discloses security elements comprising at least two contiguous areas having an identical or different optically variable coloring. The disclosed security element further comprises a single graphic marking which crosses with continuity the two areas having variable coloring so that the graphic marking straddles the two areas and is perfectly aligned.

EP 2 465 701 A2 discloses security elements for securing valuable articles comprising a stack layer made of an optically variable layer that conveys different color impressions at different viewing angles, a first portion with a first color-constant impression and a second color-constant impression and an individualizing marking. The optically variable layer and the two portions exhibiting two color-constant impressions are stacked in a covering region. The disclosed different layers are coordinated so that the color impression of the optically variable layer matches at a predetermined first viewing angle the color impression of the first portion and that the color impression of the optically variable layer matches at a predetermined second viewing angle being different from the first viewing angle the color impression of the second portion.

Alternatively or in addition to the protection against counterfeit or illegal reproduction obtained by the optically variable properties described hereabove, security threads or stripes comprising holographic structures have been developed. Commonly used processes for producing such optically variable threads comprising an holographic structure consist of laminating a partially de-metalized hologram layer on top of a fully coated color-shifting layer; such lamination leading to highly thick security threads which may cause difficulties during the integration of said threads in paper.

WO 2004/048120 A1 discloses security elements comprising at least two adjacent regions, wherein one of the regions is an optically variable and the other region has a layer of material with constant reflection. The disclosed security element comprises regions forming areas without material in order to form graphic makings, characters and the like that can be detected visually. The disclosed optically variable layer of material may be constituted by holographic material such as for example a holographic lacquer over which an embossing is performed in order to impress a holographic image.

U.S. Pat. No. 8,534,710 discloses security threads comprising a stack layer made of an optically variable layer that conveys different color impressions at different viewing angles, and a color-constant layer comprising an ink layer and a metal layer. The optically variable layer and the color-constant layer are stacked in a covering region, while at most one of the optically variable layer and the color-constant layer is present outside the covering region. The color impression of the stacked layers in the covering region and the color impression of the one layer outside the covering region are matched with each other when viewed at a predetermined viewing angle. It is further disclosed that a diffractive embossing pattern may be embossed in the optically variable layer so as to realize so-called colorshifting holograms, for example, in which the colorshifting effect of the optically variable layer is combined with a holographic effect.

U.S. Pat. No. 8,381,988 discloses security threads comprising a first and a second layer of a colourshifting material at least partially overlying each other and each having different colourshifting properties and, at least partially applied over an exposed surface of one of the colourshifting layers, a light control layer which may be a microprismatic film prepared by coating the colourshifting layer with a thermoplastic embossing lacquer and then using an embossing tool to create the light control structure with the application of heat and pressure.

US 2011/0012337 discloses security threads in which a) a colorshifting thin-film element in the form of an absorber layer, a dielectric layer and reflection layer and b) a relief pattern present in an embossing lacquer layer are stacked. The disclosed embossing lacquer layer having the relief pattern is metalized only in sub-regions so that the colorshifting thin-film element is visible when observed from the side of the relief pattern through the non-metal metalized sub-regions. However, the disclosed security threads comprising a non-printed colorshifting thin-film element may suffer from a low flexibility in terms of design and color combinations.

A need remains for providing sophisticated security threads or stripes combining high visual attractiveness with a highly sophisticated design so as to further increase the resistance against counterfeiting or illegal reproduction of security documents comprising said security threads or stripes.

SUMMARY

Accordingly, it is an object of the present invention to overcome the deficiencies of the prior art discussed above. This is achieved by the provision of security threads or stripe comprising a) an optically variable layer imparting a different color impression at different viewing angles and being made of an optically variable composition comprising from about 2 to about 40 wt-% of optically variable pigments, said optically variable layer comprising one or more gaps in the form of indicia or consist of indicia made of the optically variable composition, the weight percents being based on the total weight of the optically variable composition;

b) a color constant layer having a color matching the color impression of the optically variable layer at a viewing angle, and being made of color constant composition comprising from about 1 to about 20 wt-% of one or more dyes and/or from about 0.1 to about 45 wt-% of inorganic pigments, organic pigments or mixtures thereof, said color constant layer either comprising one or more gaps in the form of indicia or consist of indicia made of the color constant composition, the weight percents being based on the total weight of the color constant composition;

c) a holographic metallic layer; and d) a transparent substrate wherein i) the holographic metallic layer faces the environment, faces the transparent substrate and is present on the opposite side of the substrate carrying the color constant layer and the optically variable layer and ii) the color constant layer and/or the optically variable layer faces the environment, and wherein the optically variable layer, the color constant layer and the holographic metallic layer are at least partially jointly visible from at least one side of the security thread or stripe.

Also described herein are uses of the security thread or stripe described herein for the protection of a security document against counterfeiting, fraud or illegal reproduction as well as security documents comprising the security thread or stripe described herein.

The combination of the specific layers described herein provides the security thread or stripe more varieties in visual effects in comparison with traditional holographic threads of the prior art. Such a combination enhances the security and visibility of the security thread or stripe and thus increases the difficulty of the counterfeiting.

Also described herein are processes for making the security threads or stripes described herein and security threads or stripes obtained therefrom. Said processes comprising:

a) providing the transparent substrate described herein comprising the holographic metallic layer described herein, b) either b1) applying the color constant composition onto the transparent substrate on the opposite side of the substrate carrying the holographic metallic layer so as to form the color constant layer described herein by a process selected from the group consisting of offset, rotogravure, screen printing, flexography and combinations thereof either while keeping one or more gaps in the form of indicia or by applying the color constant composition in the form of indicia and hardening said color constant composition; and applying the optically variable composition described herein on the same side of the substrate carrying the color constant layer so as to form the optically variable layer by a process selected from the group consisting of rotogravure, screen printing, flexography and combinations thereof either while keeping one or more gaps in the form of indicia or by applying the optically variable composition in the form of indicia and hardening said optically variable composition, or b2) applying the optically variable composition described herein onto the transparent substrate on the opposite side of the substrate carrying the holographic metallic layer so as to form the optically variable layer described herein by a process selected from the group consisting of rotogravure, screen printing, flexography and combinations thereof either while keeping one or more gaps in the form of indicia or by applying the optically variable composition in the form of indicia, and hardening said optically variable composition; and applying the color constant composition described herein on the same side of the substrate carrying the optically variable layer so as to form the color constant layer described herein by a process selected from the group consisting of offset, rotogravure, screen printing, flexography and combinations thereof either while keeping one or more gaps in the form of indicia or by applying the color constant composition in the form of indicia and hardening said color constant composition;

c) optionally c1) applying one or more additional transparent substrates on the structure obtained under b), and/or c2) applying one or more protective varnishes so as to form one or more protective layers; and d) optionally applying one or more thermoadhesive layers on one or both sides of the structure obtained under b) or c).

Also described herein are processes producing the security documents described herein and security documents obtained therefrom. Said process comprising:

i) producing the security thread or stripe described herein, preferably by the process described herein, and ii) at least partially embedding in said security document the security thread or stripe obtained under a) or mounting the security thread or stripe obtained under a) on the surface of the security document.

DETAILED DESCRIPTION

Figure 1:
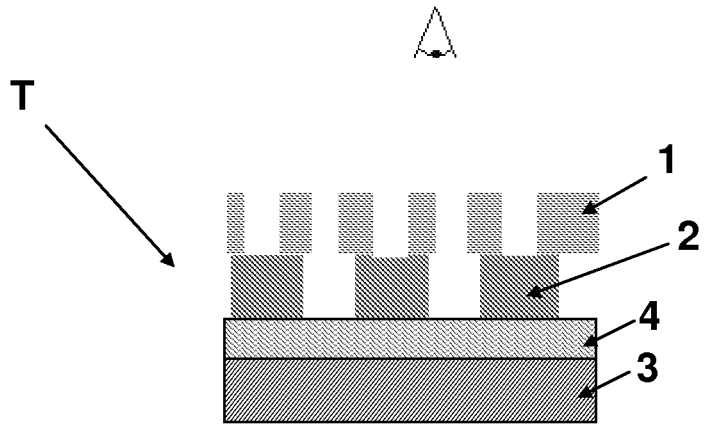
FIGS. 1, 2, 3A, 3B and 8A-8C schematically depict cross sections of security threads and stripes according to the present invention according to several exemplary embodiments.

The following definitions are to be used to interpret the meaning of the terms discussed in the description and recited in the claims.

As used herein, the article "a" indicates one as well as more than one and does not necessarily limit its referent noun to the singular.

As used herein, the term "about" in conjunction with an amount or value means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Preferably, the range denoted by the term "about" denotes a range within ±3% of the value, more preferably ±1%. Generally, when the term "about" is used, it can be expected that similar results or effects according to the invention can be obtained within a range of ±5% of the indicated value.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B". In case of "only B", the term also covers the possibility that A is absent, i.e. "only B, but not A".

As used herein, the term "at least" is meant to define one or more than one, for example one or two or three.

The term "comprising" as used herein is intended to be non-exclusive and open-ended. Thus, for instance a composition comprising a compound A may include other compounds besides A.

A thread or stripe consists of an elongated security element. By "elongated", it is meant that the dimension of the security element in the longitudinal direction is more than twice as large as its dimension in the transverse direction.

As used herein, the term "indicia" shall mean discontinuous layers such as patterns, including without limitation symbols, alphanumeric symbols, motifs, geometric patterns, letters, words, numbers, logos and drawings.

As used herein, the term "pigment" is to be understood according to the definition given in DIN 55943: 1993-11 and DIN EN 971-1: 1996-09. Pigments are materials in powder or flake form which are—contrary to dyes—not soluble in the surrounding medium.

As used herein, the terms "match" or "matched" is to be understood to mean that two color impressions substantially appear to be identical.

The security threads or stripes according to the present invention combine different color areas that, under predefined viewing conditions, seem very similar or identical and that seem different when the security threads or stripe are tilted thus conferring a high counterfeit or illegal reproduction resistance.

Optically variable elements are known in the field of security printing. Optically variable elements (also referred in the art as goniochromatic elements or colorshifting elements) exhibit a viewing-angle or incidence-angle dependent color, and are used to protect banknotes and other security documents against counterfeiting and/or illegal reproduction by commonly available color scanning, printing and copying office equipment. The optically variable layer described herein imparts a different color impression at different viewing angles By "different color impression", it is meant that the element exhibits a difference of at least one parameter of the CIELAB(1976) system, preferably exhibits a different "a*" value or a different "b*" value or different "a*" and "b*" values at different viewing angles.

For example, layers or coatings comprising optically variable pigment particles exhibit a colorshift upon variation of the viewing angle (e.g. from a viewing angle of about 90° with respect to the plane of the layer or coating to a viewing angle of about 22.5° with respect to the plane of the layer or coating) from a color impression CI1 (e.g. gold) to a color impression CI2 (green). In addition to the overt security provided by the colorshifting property which allows an easy detection, recognition and/or discrimination of the security threads or stripes described herein from their possible counterfeits with the unaided human senses, the colorshifting property may be used as a machine readable tool for the recognition of the security threads or stripes. Thus, the colorshifting properties may simultaneously be used as a covert or semi-covert security feature in an authentication process wherein the optical (e.g. spectral) properties of the security thread or stripe are analyzed. Thus, the colorshifting properties of the optically variable pigment particles may simultaneously be used as a covert or semi-covert security feature in an authentication process wherein the optical (e.g. spectral) properties of the particles are analyzed.

On the contrary to the optically variable layer that exhibits different colors or color impressions upon variation of the viewing angle, the color constant layer described herein consists of a layer that do not exhibit a color change or color impression change upon variation of the viewing angle.

The security thread or stripe described herein comprises the transparent substrate described herein, the optically variable layer described herein, the color constant layer and the holographic metallic layer described herein, wherein i) the holographic metallic layer faces the environment and faces the transparent substrate and is present on the opposite side of substrate carrying the color constant layer and the optically variable layer, and ii) the color constant layer and/or the optically variable layer faces the environment, and wherein the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer (see eyes in FIGS. 1, 2, 3 and 8).

According to one embodiment and as exemplified in FIG. 1, the security thread or stripe (T) described herein comprises the transparent substrate (4) described herein, the optically variable layer (1) described herein, the color constant layer (2) and the holographic metallic layer (3) described herein, wherein the holographic metallic layer (3) faces the environment and faces the transparent substrate (4) and is present on the opposite side of the substrate carrying the color constant layer (2) and the optically variable layer (1), wherein the optically variable layer (1) faces the environment and wherein the color constant layer (2) faces the transparent substrate (4) and the optically variable layer (1). In other words, the optically variable layer (1) is disposed on top of color constant layer (2), the color constant layer (2) is disposed on top of the transparent substrate (4) and the holographic metallic layer (3) is disposed below the transparent substrate (4) described herein. Moreover, the optically variable layer (1) described herein, the color constant layer (2) and the holographic metallic layer (3) described herein are at least partially jointly visible from the side of the security thread or stripe carrying the optically variable layer and/or the color constant layer (see the eye in FIG. 1).

Figure 2:
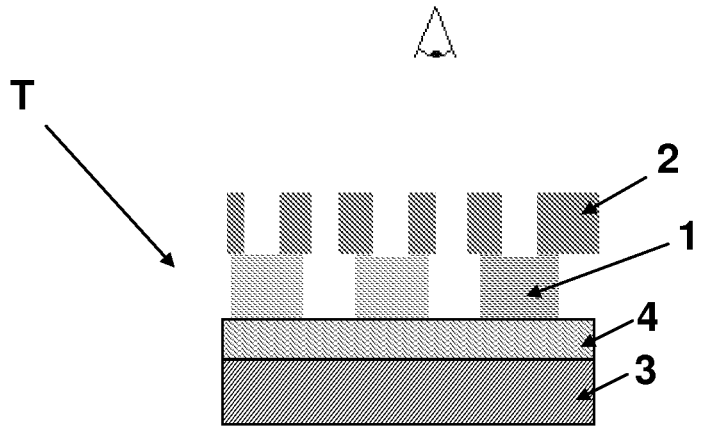

According to another embodiment and as exemplified in FIG. 2, the security thread or stripe (T) described herein comprises the transparent substrate (4) described herein, the optically variable layer (1) described herein, the color constant layer (2) and the holographic metallic layer (3) described herein, wherein the holographic metallic layer (3) faces the environment and faces the transparent substrate (4) and is present on the opposite side of the substrate carrying the color constant layer (2) and the optically variable layer (1), wherein the color constant layer (2) faces the environment, and wherein the optically variable layer (1) faces the transparent substrate (4) and the color constant layer (2). In other words, the color constant layer (2) is disposed on top of the optically variable layer (1), the optically variable layer (1) is disposed on top of the transparent substrate (4) and the holographic metallic layer (3) is disposed below the transparent substrate (4) described herein. Moreover, the optically variable layer (1) described herein, the color constant layer (2) and the holographic metallic layer (3) described herein are at least partially jointly visible from the side of the security thread or stripe carrying the optically variable layer and/or the color constant layer (see the eye in FIG. 2).

Figure 3A:
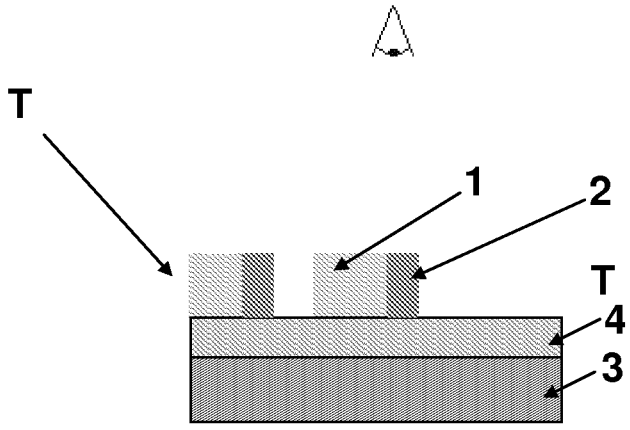
Figure 3B:
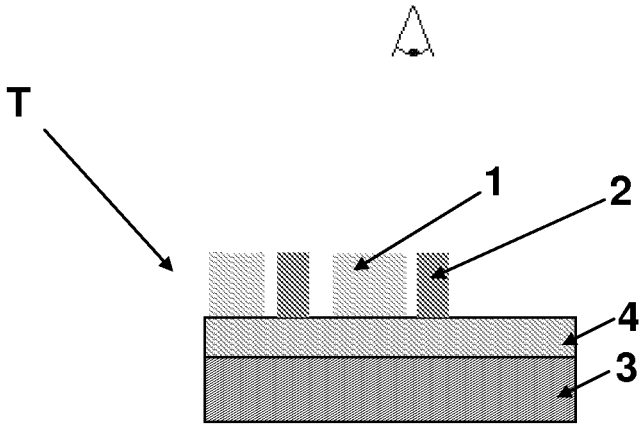

According to another embodiment as exemplified in FIGS. 3A-B, the security thread or stripe (T) described herein comprises the transparent substrate (4) described herein, the optically variable layer (1) described herein, the color constant layer (2) and the holographic metallic layer (3) described herein, wherein the holographic metallic layer (3) faces the environment and faces the transparent substrate (4) and is present on the opposite side of the transparent substrate carrying the color constant layer (2) and the optically variable layer (1), wherein the optically variable layer (1) is adjacent to the color constant layer (2) and wherein the optically variable layer (1) and the color constant layer (2) face the environment and face the transparent substrate (4). In other words, the optically variable layer (1) is adjacent to the color constant layer (2), the optically variable layer (1) and the color constant layer (2) are both disposed on top of the transparent substrate (4) and the holographic metallic layer (3) is disposed below the transparent substrate (4) described herein. Moreover, the optically variable layer (1) described herein, the color constant layer (2) and the holographic metallic layer (3) described herein are at least partially jointly visible from the side of the security thread or stripe carrying the optically variable layer and/or the color constant layer (see the eye in FIGS. 3A-B). As exemplified in FIG. 3A, the security thread or stripe described herein may comprise the optically variable layer (1) being adjacent and in direct contact with the color constant layer (2). As exemplified in FIG. 3B, the security thread or stripe described herein may comprise the optically variable layer (1) being adjacent and not in direct contact with the color constant layer (2).

Figure 4A:
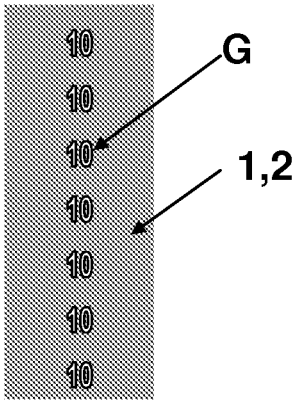
FIGS. 4A, 4B, 5A-5D, 6A-6D and 7 schematically depict top views of security threads and stripes according to the present invention according to several exemplary embodiments.

When the color constant layer (2) and/or the optically variable layer (1) comprises one or more gaps (G in FIG. 4A) in the form of indicia, said gaps consist of regions lacking the color constant layer (2) or the optically variable layer (1) as the case may be. The optically variable layer (1) and the color constant layer (2) (when comprising one or more gaps in the form of indicia) comprise material-free areas in the form of indicia. In other words, the optically variable layer (1) and the color constant layer (2) (when comprising one or more gaps in the form of indicia) described herein comprise negative writing in the form of indicia. As used herein, the term "negative writing" refers to material-free areas in an otherwise continuous layer. When the optically variable layer (1) and/or the color constant layer (2) comprise one or more gaps in the form of indicia, said one or more gaps allow an observer to see the holographic metallic layer through the one or more gaps (G). Preferably, the indicia are independently selected from the group consisting of symbols, alphanumeric symbols, motifs, geometric patterns, letters, words, numbers, logos, drawings and combinations thereof.

Figure 4B:
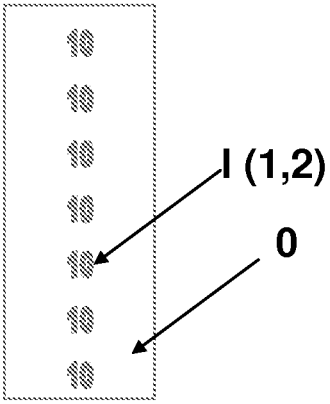

When the optically variable layer (1) and/or the color constant layer (2) consist of indicia (I in FIG. 4B) made of the optically variable composition or the color constant composition as the case may be, one or more regions lacking the optically variable layer and/or the color constant layer (0 in FIG. 4B) are present outside the indicia. When the optically variable layer (1) and/or the color constant layer (2) consist of indicia made of the optically variable composition or the color constant composition as the case may be, the presence of one or more regions lacking the optically variable composition and/or the color constant composition as the case may be outside the indicia allow an observer to see the holographic metallic layer through the one or more regions lacking the optically variable composition or the color constant composition as the case may be.

Figure 5A:
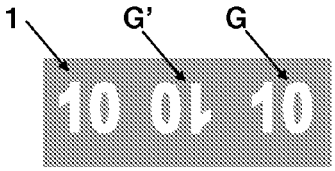
Figure 5B:
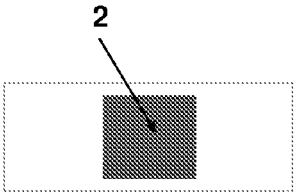
Figure 5C:
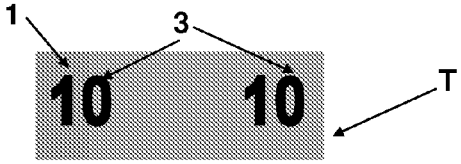
Figure 5D:
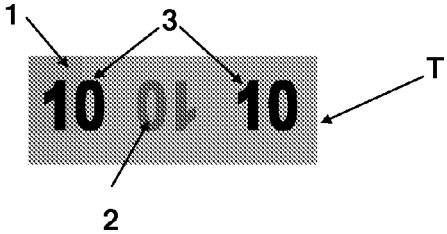

FIGS. 5C-D schematically illustrate (top views) a security thread (T) comprising an optically variable layer (1) on top of a color constant layer (2) at a first viewing angle (FIG. 5C) and at a second viewing angle (FIG. 5D). As exemplified in FIG. 5A (partial structure), the optically variable layer (1) comprises gaps in the form of indicia, said gaps may have the same shape or may have different shapes (G and G'), and exhibits a colorshift upon variation of the viewing angle (e.g. from an orthogonal view to a grazing view) from a color impression CI1 (e.g. gold) to a color impression CI2 (green). As exemplified in FIG. 5B (partial structure), the color constant layer (2) consists of indicia (square) made of a color constant composition having a color matching the color impression of the optically variable layer at a predetermined viewing angle (e.g. gold). In FIGS. 5C-D, the optically variable layer (1) and the color constant layer (2) are coordinated in such a way that at least for a part of the security thread or stripe described herein, for example:

a1) see FIG. 5D, at a predetermined viewing angle (for example at the grazing view), two kinds of indicia (made of the layers 2 and 3) which may have the same shape or may have different shapes may be observed since the color impression of the optically variable layer (1) at this viewing angle does not match with the color impression of the color constant layer (2) in such a way that, for the viewer, the optically variable layer (1), the color constant layer (2) (through the gaps G') and the holographic metallic layer (3) (through the gaps G) are jointly visible from the side of the security thread or stripe carrying the optically variable layer and/or the color constant layer, and a2) see FIG. 5C, at a different predetermined viewing angle (for example at the orthogonal view), a single kind of indicia (3) may be observed since the color impression of the optically variable layer (1) at this viewing angle is matched with the color impression of the color constant layer (2) in such a way that, for the viewer, the optically variable layer (1) and the holographic metallic layer (3) (through the gaps G) are jointly visible from the side of the security thread or stripe carrying the optically variable layer and/or the color constant layer, whereas the indicia made of the color constant layer (2) is not visible due to its matching with the color impression of the optically variable layer (1).

Figure 6A:
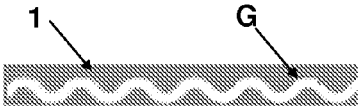
Figure 6B:
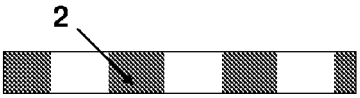
Figure 6C:
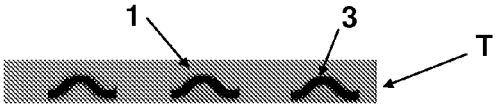
Figure 6D:
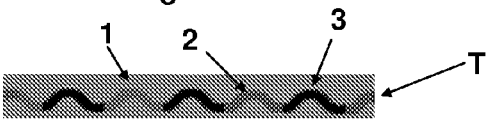

FIGS. 6C-D schematically illustrate (top views) a security thread (T) comprising an optically variable layer (1) on top of a color constant layer (2) at a first viewing angle (FIG. 6C) and a second viewing angle (6D). As exemplified in FIG. 6A (partial structure), the optically variable layer (1) comprises a gap in the form of a wave (G) and exhibits a colorshift upon variation of the viewing angle (e.g. from an orthogonal view to a grazing view) from a color impression CI1 (e.g. gold) to a color impression CI2 (green). As exemplified in FIG. 6B (partial structure), the color constant layer (2) consists of indicia (squares) made of the color constant composition having a color matching the color impression of the optically variable layer at a predetermined viewing angle (e.g. gold). In FIGS. 6C-D, the optically variable layer (1) and the color constant layer (2) are coordinated in such a way that at least for a part of the security thread or stripe described herein, for example:

b1) see FIG. 6D, at a predetermined viewing angle (for example at the grazing view), a continuous wave made of two kinds of indicia (made of the layers 2 and 3) may be observed since the color impression of the optically variable layer (1) at this viewing angle does not match with the color impression of the color constant layer (2) in such a way that, for the viewer, the optically variable layer (1), the color constant layer (2) (through the gap G) and the holographic metallic layer (3) (through the gap G) are jointly visible from the side of the security thread or stripe carrying the optically variable layer and/or the color constant layer, and b2) see FIG. 6C, at a different predetermined viewing angle (for example at the orthogonal view), a discontinuous wave of one color made of a single kind of indicia (3) may be observed since the color impression of the optically variable layer (1) at this viewing angle is matched with the color impression of the color constant layer (2) in such a way that, for the viewer, the optically variable layer (1) and the holographic metallic layer (3) (through the gap G) are jointly visible from the side of the security thread or stripe carrying the optically variable layer and/or the color constant layer, whereas the indicia made of the color constant layer (2) is not visible due to its matching with the color impression of the optically variable layer (1).

Figure 7:
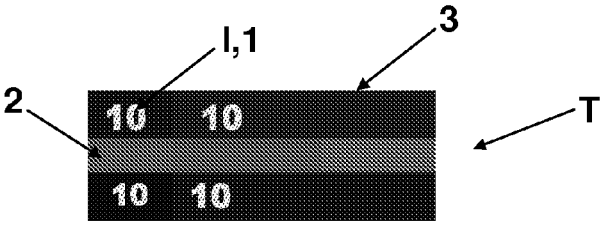
Figure 8A:
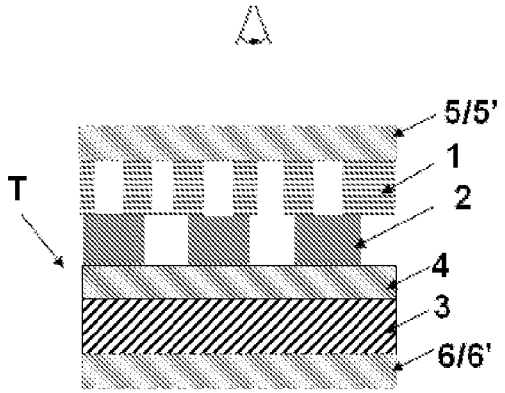
Figure 8B:
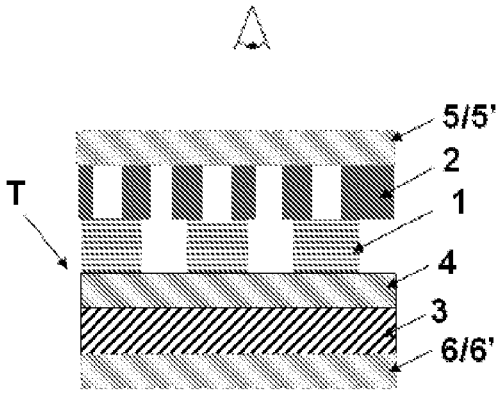
Figure 8C:
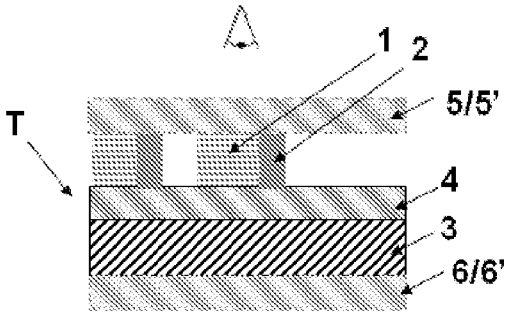

FIG. 7 schematically illustrates (top view) a security thread (T) comprising an optically variable layer (I, 1) consisting of indicia (having the shape of "10") made of the optically variable composition, a color constant layer (2) consisting of indicia (rectangular pattern) made of the color constant composition and a holographic metallic layer (3). The holographic metallic layer (3) is visible through the one or more regions lacking the optically variable composition (I, 1) and the color constant layer (2). The security thread or stripe depicted in FIG. 7 may further comprise one or more gaps in the color constant layer (2) (not shown in FIG. 7) and/or may further comprise indicia made of the optically variable composition on the color constant layer (2) (not shown in FIG. 7).

The optically variable layer described herein is made of an optically variable composition comprising from about 2 to about 40 wt-%, preferably from about 10 to about 35 wt-% of optically variable pigments, the weight percents being based on the total weight of the optically variable composition. The optically variable pigment particles are preferably selected from the group consisting of thin film interference pigments, magnetic thin film interference pigments, interference coated pigments, interference coated pigment particles comprising a magnetic material, and mixtures thereof.

The optically variable pigments described herein may be surface treated so as to protect them against any deterioration that may occur in the optically variable composition and/or to facilitate their incorporation in the variable composition; typically corrosion inhibitor materials and/or wetting agents may be used.

Suitable thin-film interference pigments exhibiting optically variable characteristics are known to those skilled in the art and disclosed in U.S. Pat. No. 4,705,300; U.S. Pat. No. 4,705,356; U.S. Pat. No. 4,721,271; U.S. Pat. No. 5,084,351; U.S. Pat. No. 5,214,530; U.S. Pat. No. 5,281,480; U.S. Pat. No. 5,383,995; U.S. Pat. No. 5,569,535, U.S. Pat. No. 5,571,624 and in the documents related to these. When at least a part of the optically variable pigment particles is constituted by thin film interference pigments, it is preferred that the thin film interference pigments comprise a Fabry-Perot reflector/dielectric/absorber multilayer structure and more preferably a Fabry-Perot absorber/dielectric/reflector/dielectric/absorber multilayer structure, wherein the absorber layers are partially transmitting and partially reflecting, the dielectric layers are transmitting and the reflective layer is reflecting the incoming light. Preferably, the reflector layer is made from one or more materials selected from the group consisting of metals, metal alloys and combinations thereof, preferably selected from the group consisting of reflective metals, reflective metal alloys and combinations thereof and more preferably selected from the group consisting of aluminum (Al), chromium (Cr), nickel (Ni), and mixtures thereof and still more preferably aluminum (Al). Preferably, the dielectric layers are independently made of one or more materials selected from the group consisting of magnesium fluoride ($MgF_2$), silicium dioxide ($SiO_2$) and mixtures thereof and more preferably magnesium fluoride ($MgF_2$). Preferably, the absorber layers are independently made of one or more materials selected from the group consisting of chromium (Cr), nickel (Ni), metallic alloys and mixtures thereof and more preferably chromium (Cr). When at least a part of the optically variable pigment particles is constituted by thin film interference pigments, it is particularly preferred that the thin film interference pigments comprise a Fabry-Perot absorber/dielectric/reflector/dielectric/absorber multilayer structure consisting of a $Cr/MgF_2/Al/MgF_2/Cr$ multilayer structure.

Magnetic thin film interference pigment particles are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Preferably, the magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure.

Preferred five-layer Fabry-Perot multilayer structures consist of absorber/dielectric/reflector/dielectric/absorber multilayer structures wherein the reflector and/or the absorber is also a magnetic layer, preferably the reflector and/or the absorber is a magnetic layer comprising nickel, iron and/or cobalt, and/or a magnetic alloy comprising nickel, iron and/or cobalt and/or a magnetic oxide comprising nickel (Ni), iron (Fe) and/or cobalt (Co).

Preferred six-layer Fabry-Perot multilayer structures consist of absorber/dielectric/reflector/magnetic/dielectric/absorber multilayer structures.

Preferred seven-layer Fabry Perot multilayer structures consist of absorber/dielectric/reflector/magnetic/reflector/dielectric/absorber multilayer structures such as disclosed in U.S. Pat. No. 4,838,648.

Preferably, the reflector layers described herein are independently made from one or more materials selected from the group consisting of metals and metal alloys, preferably selected from the group consisting of reflective metals and reflective metal alloys, more preferably selected from the group consisting of aluminum (Al), silver (Ag), copper (Cu), gold (Au), platinum (Pt), tin (Sn), titanium (Ti), palladium (Pd), rhodium (Rh), niobium (Nb), chromium (Cr), nickel (Ni), and alloys thereof, even more preferably selected from the group consisting of aluminum (Al), chromium (Cr), nickel (Ni) and alloys thereof, and still more preferably aluminum (Al). Preferably, the dielectric layers are independently made from one or more materials selected from the group consisting of metal fluorides such as magnesium fluoride ($MgF_2$), aluminum fluoride ($AlF_3$), cerium fluoride ($CeF_3$), lanthanum fluoride ($LaF_3$), sodium aluminum fluorides (e.g. $Na_3AlF_6$), neodymium fluoride ($NdF_3$), samarium fluoride ($SmF_3$), barium fluoride ($BaF_2$), calcium fluoride ($CaF_2$), lithium fluoride (LiF), and metal oxides such as silicium oxide (SiO), silicium dioxide ($SiO_2$), titanium oxide ($TiO_2$), aluminum oxide ($Al_2O_3$), more preferably selected from the group consisting of magnesium fluoride ($MgF_2$) and silicium dioxide ($SiO_2$) and still more preferably magnesium fluoride ($MgF_2$). Preferably, the absorber layers are independently made from one or more materials selected from the group consisting of aluminum (Al), silver (Ag), copper (Cu), palladium (Pd), platinum (Pt), titanium (Ti), vanadium (V), iron (Fe) tin (Sn), tungsten (W), molybdenum (Mo), rhodium (Rh), Niobium (Nb), chromium (Cr), nickel (Ni), metal oxides thereof, metal sulfides thereof, metal carbides thereof, and metal alloys thereof, more preferably selected from the group consisting of chromium (Cr), nickel (Ni), metal oxides thereof, and metal alloys thereof, and still more preferably selected from the group consisting of chromium (Cr), nickel (Ni), and metal alloys thereof. Preferably, the magnetic layer comprises nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co). When magnetic thin film interference pigment particles comprising a seven-layer Fabry-Perot structure are preferred, it is particularly preferred that the magnetic thin film interference pigment particles comprise a seven-layer Fabry-Perot absorber/dielectric/reflector/magnetic/reflector/dielectric/absorber multilayer structure consisting of a $Cr/MgF_2/Al/Ni/Al/MgF_2/Cr$ multilayer structure.

The magnetic thin film interference pigment particles described herein may be multilayer pigment particles being considered as safe for human health and the environment and being based for example on five-layer Fabry-Perot multilayer structures, six-layer Fabry-Perot multilayer structures and seven-layer Fabry-Perot multilayer structures, wherein said pigment particles include one or more magnetic layers comprising a magnetic alloy having a substantially nickel-free composition including about 40 wt-% to about 90 wt-% iron, about 10 wt-% to about 50 wt-% chromium and about 0 wt-% to about 30 wt-% aluminum. Typical examples of multilayer pigment particles being considered as safe for human health and the environment can be found in EP 2 402 401 A1 which is hereby incorporated by reference in its entirety.

Thin film interference pigment particles and magnetic thin film interference pigment particles described herein are typically manufactured by a conventional deposition technique of the different required layers onto a web. After deposition of the desired number of layers, e.g. by physical vapor deposition (PVD), chemical vapor deposition (CVD) or electrolytic deposition, the stack of layers is removed from the web, either by dissolving a release layer in a suitable solvent, or by stripping the material from the web. The so-obtained material is then broken down to flakes which have to be further processed by grinding, milling (such as for example jet milling processes) or any suitable method so as to obtain pigment particles of the required size. The resulting product consists of flat flakes with broken edges, irregular shapes and different aspect ratios. Further information on the preparation of suitable pigment particles can be found e.g. in EP 1 710 756 A1 and EP 1 666 546 A1 which are hereby incorporated by reference.

Suitable interference coated pigments include without limitation structures consisting of a substrate selected from the group consisting of metallic cores such as titanium, silver, aluminum, copper, chromium, iron, germanium, molybdenum, tantalum or nickel coated with one or more layers made of metal oxides as well as structure consisting of a core made of synthetic or natural micas, other layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures thereof coated with one or more layers made of metal oxides (e.g. titanium oxides, zirconium oxides, tin oxides, chromium oxides, nickel oxides, copper oxides and iron oxides), the structures described hereabove have been described for example in Chem. Rev. 99 (1999), G. Pfaff and P. Reynders, pages 1963-1981 and WO 2008/083894. Typical examples of these interference coated pigments include without limitation silicium oxide cores coated with one or more layers made of titanium oxide, tin oxide and/or iron oxide; natural or synthetic mica cores coated with one or more layers made of titanium oxide, silicium oxide and/or iron oxide, in particular mica cores coated with alternate layers made of silicium oxide and titanium oxide; borosilicate cores coated with one or more layers made of titanium oxide, silicium oxide and/or tin oxide; and titanium oxide cores coated with one or more layers made of iron oxide, iron oxide-hydroxide, chromium oxide, copper oxide, cerium oxide, aluminum oxide, silicium oxide, bismuth vanadate, nickel titanate, cobalt titanate and/or antimony-doped, fluorine-doped or indium-doped tin oxide; aluminum oxide cores coated with one or more layers made of titanium oxide and/or iron oxide.

Suitable interference coated pigments comprising one or more magnetic materials include without limitation structures consisting of a substrate selected from the group consisting of a core coated with one or more layers, wherein at least one of the core or the one or more layers have magnetic properties. For example, suitable interference coated pigments comprise a core made of a magnetic material such as those described hereabove, said core being coated with one or more layers made of one or more metal oxides, or they have a structure consisting of a core made of synthetic or natural micas, layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures of two or more thereof. Furthermore, one or more additional layers such as coloring layers may be present.

The color constant layer described herein is made of a color constant composition comprising from about 1 to about 20 wt-% of one or more dyes and/or from about 0.1 to about 45 wt-% of inorganic pigments, organic pigments or mixtures thereof, the weight percents being based on the total weight of the color constant composition.

Dyes suitable for inks are known in the art and are preferably selected from the group comprising reactive dyes, direct dyes, anionic dyes, cationic dyes, acid dyes, basic dyes, food dyes, metal-complex dyes, solvent dyes and mixtures thereof. Typical examples of suitable dyes include without limitation coumarines, cyanines, oxazines, uranines, phtalocyanines, indolinocyanines, triphenylmethanes, naphtalocyanines, indonanaphtalo-metal dyes, anthraquinones, anthrapyridones, azo dyes, rhodamines, squarilium dyes, croconium dyes. Typical examples of dyes suitable for the present invention include without limitation C.I. Acid Yellow 1, 3, 5, 7, 11, 17, 19, 23, 25, 29, 36, 38, 40, 42, 44, 49, 54, 59, 61, 70, 72, 73, 75, 76, 78, 79, 98, 99, 110, 111, 121, 127, 131, 135, 142, 157, 162, 164, 165, 194, 204, 236, 245; C.I. Direct Yellow 1, 8, 11, 12, 24, 26, 27, 33, 39, 44, 50, 58, 85, 86, 87, 88, 89, 98, 106, 107, 110, 132, 142, 144; C.I. Basic Yellow 13, 28, 65; C.I. Reactive Yellow 1, 2, 3, 4, 6, 7, 11, 12, 13, 14, 15, 16, 17, 18, 22, 23, 24, 25, 26, 27, 37, 42; C.I. Food Yellow 3, 4; C.I. Acid Orange 1, 3, 7, 10, 20, 76, 142, 144; C.I. Basic Orange 1, 2, 59; C.I. Food Orange 2; C.I. Orange B; C.I. Acid Red 1, 4, 6, 8, 9, 13, 14, 18, 26, 27, 32, 35, 37, 42, 51, 52, 57, 73, 75, 77, 80, 82, 85, 87, 88, 89, 92, 94, 97, 106, 111, 114, 115, 117, 118, 119, 129, 130, 131, 133, 134, 138, 143, 145, 154, 155, 158, 168, 180, 183, 184, 186, 194, 198, 209, 211, 215, 219, 221, 249, 252, 254, 262, 265, 274, 282, 289, 303, 317, 320, 321, 322, 357, 359; C.I. Basic Red 1, 2, 14, 28; C.I. Direct Red 1, 2, 4, 9, 11, 13, 17, 20, 23, 24, 28, 31, 33, 37, 39, 44, 46, 62, 63, 75, 79, 80, 81, 83, 84, 89, 95, 99, 113, 197, 201, 218, 220, 224, 225, 226, 227, 228, 229, 230, 231, 253; C.I. Reactive Red 1, 2, 3, 4, 5, 6, 7, 8, 11, 12, 13, 15, 16, 17, 19, 20, 21, 22, 23, 24, 28, 29, 31, 32, 33, 34, 35, 36, 37, 38, 39, 40, 41, 42, 43, 45, 46, 49, 50, 58, 59, 63, 64, 108, 180; C.I. Food Red 1, 7, 9, 14; C.I. Acid Blue 1, 7, 9, 15, 20, 22, 23, 25, 27, 29, 40, 41, 43, 45, 54, 59, 60, 62, 72, 74, 78, 80, 82, 83, 90, 92, 93, 100, 102, 103, 104, 112, 113, 117, 120, 126, 127, 129, 130, 131, 138, 140, 142, 143, 151, 154, 158, 161, 166, 167, 168, 170, 171, 182, 183, 184, 187, 192, 193, 199, 203, 204, 205, 229, 234, 236, 249, 254, 285; C.I. Basic Blue 1, 3, 5, 7, 8, 9, 11, 55, 81; C.I. Direct Blue 1, 2, 6, 15, 22, 25, 41, 71, 76, 77, 78, 80, 86, 87, 90, 98, 106, 108, 120, 123, 158, 160, 163, 165, 168, 192, 193, 194, 195, 196, 199, 200, 201, 202, 203, 207, 225, 226, 236, 237, 246, 248, 249; C.I. Reactive Blue 1, 2, 3, 4, 5, 7, 8, 9, 13, 14, 15, 17, 18, 19, 20, 21, 25, 26, 27, 28, 29, 31, 32, 33, 34, 37, 38, 39, 40, 41, 43, 44, 46, 77; C.I. Food Blue 1, 2; C.I. Acid Green 1, 3, 5, 16, 26, 104; C.I. Basic Green 1, 4; C.I: Food Green 3; C.I. Acid Violet 9, 17, 90, 102, 121; C.I. Basic Violet 2, 3, 10, 11, 21; C.I. Acid Brown 101, 103, 165, 266, 268, 355, 357, 365, 384; C.I. Basic Brown 1; C.I. Acid Black 1, 2, 7, 24, 26, 29, 31, 48, 50, 51, 52, 58, 60, 62, 63, 64, 67, 72, 76, 77, 94, 107, 108, 109, 110, 112, 115, 118, 119, 121, 122, 131, 132, 139, 140, 155, 156, 157, 158, 159, 191, 194; C.I. Direct Black 17, 19, 22, 32, 39, 51, 56, 62, 71, 74, 77, 94, 105, 106, 107, 108, 112, 113, 117, 118, 132, 133, 146, 154, 168; C.I. Reactive Black 1, 3, 4, 5, 6, 8, 9, 10, 12, 13, 14, 18, 31; C.I. Food Black 2; C.I. Solvent Yellow 19, C.I. Solvent Orange 45, C.I. Solvent Red 8, C.I. Solvent Green 7, C.I. Solvent Blue 7, C.I. Solvent Black 7; C.I. Disperse Yellow 3, C.I. Disperse Red 4, 60, C.I. Disperse Blue 3, and metal azo dyes disclosed in U.S. Pat. No. 5,074,914, U.S. Pat. No. 5,997,622, U.S. Pat. No. 6,001,161, JP 02-080470, JP 62-190272, JP 63-218766. Suitable dyes for the present invention may be infrared absorbing dyes, luminescent dyes.

Typical examples of organic and inorganic pigments suitable for the present invention include without limitation C.I. Pigment Yellow 12, C.I. Pigment Yellow 42, C.I. Pigment Yellow 93, 109, C.I. Pigment Yellow 110, C.I. Pigment Yellow 147, C.I. Pigment Yellow 173, C.I. Pigment Orange 34, C.I. Pigment Orange 48, C.I. Pigment Orange 49, C.I. Pigment Orange 61, C.I. Pigment Orange 71 C.I. Pigment Orange 73, C.I. Pigment Red 9, C.I. Pigment Red 22, C.I. Pigment Red 23, C.I. Pigment Red 67, C.I. Pigment Red 122, C.I. Pigment Red 144, C.I. Pigment Red 146, C.I. Pigment Red 170, C.I. Pigment Red 177, C.I. Pigment Red 179, C.I. Pigment Red 185, C.I. Pigment Red 202, C.I. Pigment Red 224, C.I. Pigment Red 242, C.I. Pigment Red 254, C.I. Pigment Red 264, C.I. Pigment Brown 23, C.I. Pigment Blue 15, C.I. Pigment Blue 15:3, C.I. Pigment Blue 60, C.I. Pigment Violet 19, C.I. Pigment Violet 23, C.I. Pigment Violet 32, C.I. Pigment Violet 37, C.I. Pigment Green 7, C.I. Pigment Green 36, C.I. Pigment Black 7, C.I. Pigment Black 11, metal oxides such as titanium dioxide, antimony yellow, lead chromate, lead chromate sulfate, lead molybdate, ultramarine blue, cobalt blue, manganese blue, chrome oxide green, hydrated chrome oxide green, cobalt green and metal sulfides, such as cerium or cadmium sulfide, cadmium sulfoselenides, zinc ferrite, bismuth vanadate, Prussian blue, $Fe_3O_4$, carbon black, mixed metal oxides, azo, azomethine, methine, anthraquinone, phthalocyanine, perinone, perylene, diketopyrrolopyrrole, thioindigo, thiazinindigo, dioxazine, iminoisoindoline, iminoisoindolinone, quinacridone, flavanthrone, indanthrone, anthrapyrimidine and quinophthalone pigments.

The security thread or stripe described herein comprises an optically variable layer made of an optically variable composition and a color constant layer made of a color constant composition, said compositions are preferably independently selected from the group consisting of radiation curable compositions, thermal drying compositions and combinations thereof.

According to one aspect of the present invention, the optically variable composition and/or the color constant composition described herein consist of thermal drying coating compositions. Thermal drying coating compositions consist of coating compositions of any type of aqueous compositions or solvent-based compositions which are dried by hot air, infrared or by a combination of hot air and infrared. Typical examples of thermal drying coating compositions comprises components including without limitation resins such as polyester resins, polyether resins, vinyl chloride polymers and vinyl chloride based copolymers, nitrocellulose resins, cellulose acetobutyrate or acetopropionate resins, maleic resins, polyamides, polyolefins, polyurethane resins, functionalized polyurethane resins (e.g. carboxylated polyurethane resins), polyurethane alkyd resins, polyurethane-(meth)acrylate resins, urethane-(meth) acrylic resins, styrene (meth)acrylate resins or mixtures thereof. The term "(meth)acrylate" or "(meth)acrylic" in the context of the present invention refers to the acrylate as well as the corresponding methacrylate or refers to the acrylic as well as the corresponding methacrylic. As used herein, the term "solvent-based compositions" refers to compositions whose liquid medium or carrier substantially consists of one or more organic solvents. Examples of such solvents include without limitation alcohols (such as for example methanol, ethanol, isopropanol, n-propanol, ethoxy propanol, n-butanol, sec-butanol, tert-butanol, iso-butanol, 2-ethylhexyl-alcohol and mixtures thereof); polyols (such as for example glycerol, 1,5-pentanediol, 1,2,6-hexanetriol and mixtures thereof); esters (such as for example ethyl acetate, n-propyl acetate, n-butyl acetate and mixtures thereof); carbonates (such as for example dimethyl carbonate, diethylcarbonate, di-n-butylcarbonate, 1,2-ethylencarbonate, 1,2-propylenecarbonate, 1,3-propylencarbonate and mixtures thereof); aromatic solvents (such as for example toluene, xylene and mixtures thereof); ketones and ketone alcohols (such as for example acetone, methyl ethyl ketone, methyl isobutyl ketone, cyclohexanone, diacetone alcohol and mixtures thereof); amides (such as for example dimethylformamide, dimethyl-acetamide and mixtures thereof); aliphatic or cycloaliphatic hydrocarbons; chlorinated hydrocarbons (such as for example dichloromethane); nitrogen-containing heterocyclic compound (such as for example N-methyl-2-pyrrolidone, 1,3-dimethyl-2-imidazolidone and mixtures thereof); ethers (such as for example diethyl ether, tetrahydrofuran, dioxane and mixtures thereof); alkyl ethers of a polyhydric alcohol (such as for example 2-methoxyethanol, 1-methoxypropan-2-ol and mixtures thereof); alkylene glycols, alkylene thioglycols, polyalkylene glycols or polyalkylene thioglycols (such for example ethylene glycol, polyethylene glycol (such as for example diethylene glycol, triethylene glycol, tetraethylene glycol), propylene glycol, polypropylene glycol (such as for example dipropylene glycol, tripropylene glycol), butylene glycol, thiodiglycol, hexylene glycol and mixtures thereof); nitriles (such as for example acetonitrile, propionitrile and mixtures thereof), and sulfur-containing compounds (such as for example dimethylsulfoxide, sulfolan and mixtures thereof). Preferably, the one or more organic solvents are selected from the group consisting of alcohols, esters and mixtures thereof.

According to another aspect of the present invention, the optically variable composition and/or the color constant composition described herein consist of radiation curable coating compositions. Radiation curable coating compositions include compositions that may be cured UV-visible light radiation (hereafter referred as UV-Vis-curable) or by E-beam radiation (hereafter referred as EB). Radiation curable coating compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. Preferably, the coating compositions described herein consist of UV-Vis-curable coating compositions. Preferably the UV-Vis-curable coating compositions described herein are prepared from oligomers (also referred in the art as prepolymers) selected from the group consisting of radically curable compounds, cationically curable compounds and mixtures thereof. Cationically curable compounds are cured by cationic mechanisms consisting of the activation by energy of one or more photoinitiators which liberate cationic species, such as acids, which in turn initiate the polymerization so as to form the binder. Radically curable compounds are cured by free radical mechanisms consisting of the activation by energy of one or more photoinitiators which liberate free radicals which in turn initiate the polymerization so as to form the binder. UV-Vis curing of a monomer, oligomer or prepolymer may require the presence of one or more photoinitiators and may be performed in a number of ways. As known by those skilled in the art, the one or more photoinitiators are selected according to their absorption spectra and are selected to fit with the emission spectra of the radiation source. Depending on the monomers, oligomers or prepolymers used in the UV-Vis-curable coating compositions described herein, different photoinitiators might be used. Suitable examples of free radical photoinitiators are known to those skilled in the art and include without limitation acetophenones, benzophenones, alpha-aminoketones, alpha-hydroxyketones, phosphine oxides and phosphine oxide derivatives and benzyldimethyl ketals. Suitable examples of cationic photoinitiators are known to those skilled in the art and include without limitation onium salts such as organic iodonium salts (e.g. diaryl iodoinium salts), oxonium (e.g. triaryloxonium salts) and sulfonium salts (e.g. triarylsulphonium salts). Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX) and mixtures thereof. The one or more photoinitiators comprised in the UV-Vis-curable coating compositions are preferably present in an amount from about 0.1 wt-% to about 20 wt-%, more preferably about 1 wt-% to about 15 wt-%, the weight percents being based on the total weight of the UV-Vis-curable coating compositions.

Alternatively, dual-cure coating compositions may be used; these coating compositions combine thermal drying and radiation curing mechanisms. Typically, such compositions are similar to radiation curing compositions but include a volatile part constituted by water and/or by solvent. These volatile constituents are evaporated first using hot air and/or IR driers, and UV-Vis drying is then completing the hardening process.

The optically variable composition and/or the color constant composition described herein may further comprise one or more machine readable materials. When present, the one or more machine readable materials are preferably independently selected from the group consisting of magnetic materials, luminescent materials, electrically conductive materials, infrared-absorbing materials and mixtures thereof. As used herein, the term "machine readable material" refers to a material which exhibits at least one distinctive property which is detectable by a device or a machine, and which can be comprised in a coating or layer so as to confer a way to authenticate said coating or article comprising said coating by the use of a particular equipment for its detection and/or authentication.

The optically variable composition and/or the color constant composition described herein may independently further comprise one or more additives including without limitation compounds and materials which are used for adjusting physical, rheological and chemical parameters of the composition such as the viscosity (e.g. solvents and surfactants), the consistency (e.g. anti-settling agents, fillers and plasticizers), the foaming properties (e.g. antifoaming agents), the lubricating properties (waxes), UV stability (photosensitizers and photostabilizers) and adhesion properties, etc. Additives described herein may be present in the coating compositions described herein in amounts and in forms known in the art, including in the form of so-called nano-materials where at least one of the dimensions of the particles is in the range of 1 to 1000 nm.

The optically variable composition and the color constant composition described herein may be independently prepared by dispersing or mixing the optically variable pigments described herein, the one or more dyes described therein and/or the inorganic pigments, organic pigments or mixtures thereof described herein as the case may be, and the one or more additives when present in the presence of the binder described herein, thus forming liquid compositions. When present, the one or more photoinitiators may be added to the composition either during the dispersing or mixing of all other ingredients or may be added at a later stage, i.e. after the formation of the liquid composition.

The security thread or stripe described herein comprises a holographic metallic layer. Holographic metallic layers are well known in the field of the protection of security documents or articles against counterfeiting and/or illegal reproduction. The holographic metallic layer consists of a metallic relief pattern present in an embossing lacquer layer. The relief pattern provides a hologram or other surface relief-based structure. The relief pattern can take various forms including diffraction gratings, holographic patterns such as two-dimensional and three-dimensional holographic images, corner cube reflectors, zero order diffraction patterns, moiré patterns, or other light interference patterns, including those based on microstructures having dimensions in the range from about 0.1 μm to about 10 μm and various combinations of the above such as hologram/grating images, or other interference patterns. The relief pattern is made of a reflective metal including without limitation aluminum, silver, nickel, silver-palladium, silver-copper alloy, copper, gold, and the like. The holographic metallic layer described herein may comprise one or more demetalized parts in the form of indicia in negative writing (also referred in the art as clear text) or positive writing. By "positive writing", it is meant that the indicia consist of a metal surrounded by a demetalized area and by "negative writing"; it is meant that the indicia consist of negative text, i.e. a metal material comprising demetalized areas in the form of indicia in negative writing. The demetalized parts may be produced by processes known to those skilled in the art such as for example chemical etching, laser etching or washing methods. When the holographic metallic layer described herein comprises one or more demetalized areas, the optically variable layer, the color constant layer and the holographic metallic layer are at least partially jointly visible from at least one side of the security thread or stripe, said at least one side being the side of the security thread or stripe carrying the optically variable layer and the color constant layer and/or the side of the security thread or stripe carrying the holographic metallic layer.

Methods for producing holographic metallic layers are well known by those skilled in the art. For example, a surface of layer may be embossed by well known methods, such as by pressing it in contact with a heated nickel embossing shim at high pressure. Other methods include photolithography and molding of a plastic substrate against a patterned surface. Holographic metallic layers can be produced from a thermoplastic film that has been embossed by heat softening the surface of the film and then passing the film through embossing rollers that impart the diffraction grating or holographic image onto the softened surface. In this way, sheets of effectively unlimited length can be formed with the diffraction grating or holographic image thereon. Alternatively, holographic metallic layers can be made by passing a roll of plastic film coated with an ultraviolet (UV) curable polymer, such as PMMA, through a set of UV transparent rollers whereby the rollers set a pattern into the UV curable polymer and the polymer is cured by a UV light that passes through the UV transparent rollers. One the associated surface relief structure is prepared, the reflective metal described herein is deposited in a desired pattern.

The security thread or stripe described herein comprises a transparent substrate. Preferably, the transparent substrate is made of one or more plastics or polymers preferably selected form the group consisting of polyolefins (e.g. polyethylene and polypropylene), polyamides, polyesters (e.g. poly(ethylene terephthalate) (PET), poly(1,4-butylene terephthalate) (PBT) and poly(ethylene 2,6-naphthoate) (PEN)), polyvinylchlorides (PVC) and mixtures thereof.

The security thread or stripe described herein may further comprise one or more additional transparent substrates. As exemplified in FIGS. 8A-C, the one or more additional transparent substrates (5, 6) faces the environment, i.e. said one or more additional transparent substrates (5, 6) faces outwardly, so that the optically variable layer (1) and the color constant layer (2) are comprised between the transparent substrate (4) and the one or more additional transparent substrates (5) and/or the holographic metallic layer (3) is comprised between the transparent substrate (4) and the one or more additional transparent substrates (6) in the security thread or stripe (T) and the optically variable layer (1), the color constant layer (2) and the holographic metallic layer (3) are at least partially jointly visible from the side of the security thread or stripe carrying the optically variable layer (1) and/or the color constant layer (2) (see eyes in FIGS. 8A-C). The transparent substrate (4) described herein and the optional one or more additional transparent substrates (5, 6) described herein may be different or may be the same. Preferably, the optional one or more additional transparent substrates described herein are independently made of one or more plastics or polymers more preferably selected form the group consisting of polyolefins (e.g. polyethylene and polypropylene), polyamides, polyesters (e.g. poly(ethylene terephthalate) (PET), poly(1,4-butylene terephthalate) (PBT) and poly(ethylene 2,6-naphthoate) (PEN)), polyvinylchlorides (PVC) and mixtures thereof.

With the aim of increasing the mechanical and/or wear and soil resistance or with the aim of modifying the optical gloss or aesthetic appearance of the security thread or stripe described herein, the security thread or stripe described herein may further comprise one or more protective layers. As exemplified in FIGS. 8A-C, the one or more protective layers (5', 6') face the environment and may be present on the side of the substrate carrying the optically variable layer (1) and the color constant layer (2) and/or may be present on the opposite side of the side of substrate carrying the holographic metallic layer (3). When present, the one or more protective layers may be continuous or discontinuous. When present, the one or more protective layers are typically made of one or more protective varnishes which are transparent or slightly colored or tinted so that the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer. The one or more protective varnish may be more or less glossy. Protective varnishes may be radiation curable compositions, thermal drying compositions or any combination thereof such as those described hereabove. Preferably, the one or more protective layers are made of radiation curable, more preferably UV-Vis curable, compositions.

The security thread or stripe described herein may further comprise one or more additional layers preferably selected from the group consisting of adhesive layers, lacquers, machine readable layers, hiding layers and combinations thereof, provided that the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer. When present, the one or more additional layers may be continuous or discontinuous.

The security thread or stripe described herein may further comprise one or more adhesive layers, preferably one or more thermoadhesive layers, on at least one side or both sides of said security thread or stripe so as to provide adherence to a security document upon incorporation of the security thread or stripe into or onto said security document. The one or more adhesive layers, preferably one or more thermoadhesive layers, are present between i) the outermost layer of the optically variable layer (1), the color constant layer (2), the one or more additional transparent substrates (5) when present and the one or more protective layers (5') when present and ii) the security document and/or between the outermost layer of the holographic metallic layer (3), the one or more additional transparent substrates (6) when present and the one or more protective layers (6') when present and ii) the security document.

With the aim of facilitating an automatic authenticity check of the security thread or stripe described herein or a security document comprising said security thread or stripe by an authentication apparatus such as for example an automatic teller machine (ATMs), the security thread or stripe described herein may further comprise one or more machine readable layers, provided that the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer. Said one or more machine readable layers may be continuous or discontinuous. When present, the one or more machine readable layers preferably comprise a machine readable material selected from the group consisting of magnetic materials, luminescent materials, electrically conductive materials, infrared-absorbing materials and mixtures thereof.

With the aim of further increasing the resistance against counterfeiting or illegal reproduction of the security thread or stripe described herein, it might be advantageous to apply one or more hiding layers so as to camouflage any information that is present in the security thread or stripe such as for example any information related to the one or more machine readable layers described hereabove. For example, magnetic or other machine readable information which is visually discernible could be more easily counterfeited if the potential counterfeiter can detect the presence and/or the placement of the magnetic regions to read. If the magnetic or other machine readable information cannot be visually seen, the counterfeiter will not be motivated to reproduce this information and therefore the counterfeiting will fail and be easily detected if illegally reproduced. Typical examples of hiding layers include without limitation aluminum layers, black layers, white layers, opaque colored layers and metalized layers and combination of thereof. As mentioned hereabove for the one or more machine readable layers, the one or more hiding layers may be may be continuous or discontinuous and are preferably apply on the one or more machine readable layers provided that the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer.

The present invention provides processes for producing the security threads or stripes described herein, said processes comprising:

a) providing the transparent substrate described herein and comprising the holographic metallic layer described herein, b) either b1) applying the color constant composition described herein onto the transparent substrate described herein on the opposite side of the substrate carrying the holographic metallic layer so as to form the color constant layer described herein by a process selected from the group consisting of offset, rotogravure, screen printing, flexography and combinations thereof either while keeping one or more gaps in the form of indicia or by applying the color constant composition in the form of indicia and hardening said color constant composition; and applying the optically variable composition described herein on the same side of the substrate carrying the color constant layer so as to form the optically variable layer described herein by a process selected from the group consisting of rotogravure, screen printing, flexography and combinations thereof either while keeping one or more gaps in the form of indicia or by applying the optically variable composition in the form of indicia and hardening said optically variable composition, or b2) applying the optically variable composition described herein onto the transparent substrate described herein on the opposite side of the substrate carrying the holographic metallic layer so as to form the optically variable layer described herein by a process selected from the group consisting of rotogravure, screen printing, flexography and combinations thereof either while keeping one or more gaps in the form of indicia or by applying the optically variable composition in the form of indicia, and hardening said optically variable composition; and applying the color constant composition described herein on the same side of the substrate carrying the optically variable layer so as to form the color constant layer described herein by a process selected from the group consisting of offset, rotogravure, screen printing, flexography and combinations thereof either while keeping one or more gaps in the form of indicia or by applying the color constant composition in the form of indicia and hardening said color constant composition;

c) optionally c1) applying one or more additional transparent substrates on the structure obtained under b) and/or c2) applying one or more protective varnishes so as to form one or more protective layers on the structure obtained under b); and d) optionally applying one or more adhesive layers, preferably one or more thermoadhesive layers, on one or both sides of the structure obtained under b) or c).

When the security thread or stripe described herein comprises the optically variable layer (1) facing the environment and the color constant layer (2) facing the transparent substrate (4) and the optically variable layer (1) (i.e. when the optically variable layer (1) is disposed on top of color constant layer (2)), as depicted in FIG. 1, the process described herein is carried out with b1), i.e. the color constant composition is first applied as described herein onto the transparent substrate (4) described herein so as to form the color constant layer (2) described and hardened and, subsequently, the optically variable composition is applied as described herein so as to form the optically variable layer (1) and hardened.

When the security thread or stripe described herein comprises the color constant layer (2) facing the environment and the optically variable layer (1) facing the transparent substrate (4) and the optically variable layer (1) (i.e. when the color constant layer (2) is disposed on top of optically variable layer (1)), as depicted in FIG. 2, the process described herein is carried out with b2), i.e. the optically variable composition is first applied onto the transparent substrate (4) so as to form the optically variable layer (1) described and hardened and, subsequently, the color constant composition is applied as described herein so as to form the color constant layer (2) described herein and hardened.

When the security thread or stripe described herein comprises the optically variable layer (1) being adjacent to the color constant layer (2) and both layers facing the transparent substrate (4) (i.e. when the optically variable layer is adjacent to the color constant layer (2) and when the optically variable layer (1) and the color constant layer (2) are both disposed on top of the transparent substrate (4)), as depicted in FIGS. 3A-B, the process described herein is carried out with b1) or b2).

As mentioned hereabove, the optically variable composition and the color constant composition are applied by a printing process so as to form an optically variable layer and a color constant layer respectively. Using printing processes for producing the security threads or stripes described herein provides a high flexibility in terms of designs and color combinations.

The rotogravure, screen printing and flexography described herein are well-known to the skilled man and are described for example in Printing Technology, J. M. Adams and P. A. Dolin, Delmar Thomson Learning, $5^{th}$ Edition.

As known by those skilled in the art, the term rotogravure refers to a printing process which is described for example in "Handbook of print media", Helmut Kipphan, Springer Edition, pages 360-394. Rotogravure is a printing process wherein the image or pattern elements are engraved into the surface of the gravure cylinder. The printing assembly further comprises an impression roller. The term rotogravure does not encompass intaglio printing processes (also referred in the art as engraved steel die or copper plate printing processes) which rely for example on a different type of ink or composition. The non-image areas are at a constant original level. Prior to printing, the entire printing plate (non-printing and printing elements) is inked and flooded with ink or composition. The image or pattern consists of cells (or wells) engraved into the gravure cylinder. The excess of ink or composition in the non-image area is removed by a wiper or a blade before printing, so that ink or composition remains only in the recessed cells. The image or pattern is transferred from the recessed cells to the substrate by a combination of pressure typically in the range of 1 to 4 bars, capillarity and by the adhesive forces between the substrate and the ink or composition. The term rotogravure does not encompass intaglio printing processes (also referred in the art as engraved steel die or copper plate printing processes) which rely for example on a different type of ink or composition. Screen printing (also referred in the art as silkscreen printing) is a stencil process whereby a composition is transferred to a surface through a stencil supported by a fine fabric mesh of silk, synthetic fibers or metal threads stretched tightly on a frame. The pores of the mesh are blocked-up in the non-image areas and left open in the image area, the image carrier being called the screen. During printing, the frame is supplied with the composition which is flooded over the screen and a urging device such as for example a squeegee is then drawn across it, thus forcing the composition through the open pores of the screen. At the same time, the surface to be printed is held in contact with the screen and the ink or composition is transferred to it. Preferably a rotary screen cylinder is used. Screen printing is further described for example in The Printing ink manual, R. H. Leach and R. J. Pierce, Springer Edition, $5^{th}$ Edition, pages 58-62 and in Printing Technology, J. M. Adams and P. A. Dolin, Delmar Thomson Learning, $5^{th}$ Edition, pages 293-328. Flexography preferably uses a unit with a doctor blade, preferably a chambered doctor blade, an anilox roller and plate cylinder. The anilox roller advantageously has small cells whose volume and/or density determines the composition application rate. The doctor blade lies against the anilox roller, and scraps off surplus composition at the same time. The anilox roller transfers the composition to the plate cylinder which finally transfers the composition to the substrate. Specific design might be achieved using a designed photopolymer plate. Plate cylinders can be made from polymeric or elastomeric materials. Polymers are mainly used as photopolymer in plates and sometimes as a seamless coating on a sleeve. Photopolymer plates are made from light-sensitive polymers that are hardened by ultraviolet (UV) light. Photopolymer plates are cut to the required size and placed in an UV light exposure unit. One side of the plate is completely exposed to UV light to harden or cure the base of the plate. The plate is then turned over, a negative of the job is mounted over the uncured side and the plate is further exposed to UV light. This hardens the plate in the image areas. The plate is then processed to remove the unhardened photopolymer from the nonimage areas, which lowers the plate surface in these nonimage areas. After processing, the plate is dried and given a post-exposure dose of UV light to cure the whole plate. Preparation of plate cylinders for flexography is described in Printing Technology, J. M. Adams and P. A. Dolin, Delmar Thomson Learning, $5^{th}$ Edition, pages 359-360.

Subsequently to the application by the printing process described herein of the color constant composition, said composition is hardened. The same applies for the optically variable composition. The hardening described herein may be any process that increases the viscosity of the composition such that a substantially solid material adhering to the substrate is formed. The hardening described herein may independently involve a physical process based on the evaporation of a volatile component, such as a solvent, and/or water evaporation (i.e. physical drying). Herein, hot air, infrared or a combination of hot air and infrared may be used. Alternatively, the hardening described herein may independently include a chemical reaction which is not reversed by a simple temperature increase that may occur during a typical use of the security thread described, such as a curing, polymerizing or cross-linking of the binder and optional initiator compounds and/or optional cross-linking compounds comprised in the composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts preferably selected from the group consisting of cobalt-containing catalysts, vanadium-containing catalysts, zirconium-containing catalysts, bismuth-containing catalysts, and manganese-containing catalysts); cross-linking reactions or any combination thereof.

When the optically variable composition comprises optically variable pigments selected from the group consisting of magnetic thin film interference pigments, interference coated pigment particles comprising a magnetic material and mixtures thereof, preferably magnetic thin film interference pigments, said optically variable pigment may be oriented in the optically variable layer of the security thread described herein, i.e. not randomly distributed and aligned. By comprising the magnetic thin film interference pigments, interference coated pigment particles comprising a magnetic material or mixtures thereof described herein, the optically variable composition described herein is well-suited for producing security threads exhibiting dynamic, three-dimensional, illusionary, and/or kinematic images by aligning the pigment within the optically variable composition with a magnetic field. A large variety of optical effects can be produced by various methods disclosed for example in U.S. Pat. No. 6,759,097, EP 2 165 774 A1 and EP 1 878 773 B1. Optical effects known as flip-flop effects (also referred in the art as switching effect) may be produced. Flip-flop effects include a first printed portion and a second printed portion separated by a transition, wherein pigment particles are aligned parallel to a first plane in the first portion and pigment particles in the second portion are aligned parallel to a second plane. Methods for producing flip-flop effects are disclosed for example in EP 1 819 525 B1 and EP 1 819 525 B1. Optical effects known as rolling-bar effects may also be produced. Rolling-bar effects show one or more contrasting bands which appear to move ("roll") as the image is tilted with respect to the viewing angle, said optical effects are based on a specific orientation of magnetic or magnetizable pigment particles, said pigment particles being aligned in a curving fashion, either following a convex curvature (also referred in the art as negative curved orientation) or a concave curvature (also referred in the art as positive curved orientation. Methods for producing rolling-bar effects are disclosed for example in EP 2 263 806 A1, EP 1 674 282 B1, EP 2 263 807 A1, WO 2004/007095 A2 and WO 2012/104098 A1. Optical effects known as Venetian-blind effects may also be produced. Venetian-blind effects include pigment particles being oriented such that, along a specific direction of observation, they give visibility to an underlying substrate surface, such that indicia or other features present on or in the substrate surface become apparent to the observer while they impede the visibility along another direction of observation. Methods for producing Venetian-blind effects are disclosed for example in U.S. Pat. No. 8,025,952 and EP 1 819 525 B1. Optical effects known as moving-ring effects may also be produced. Moving-ring effects consists of optically illusive images of objects such as funnels, cones, bowls, circles, ellipses, and hemispheres that appear to move in any x-y direction depending upon the angle of tilt of said optical effect layer. Methods for producing moving-ring effects are disclosed for example in EP 1 710 756 A1, U.S. Pat. No. 8,343,615, EP 2 306 222 A1, EP 2 325 677 A2, WO 2011/092502 A2 and US 2013/084411

While the optically variable composition comprising the optically variable pigments selected from the group consisting of magnetic thin film interference pigments interference coated pigment particles comprising a magnetic material and mixtures thereof is still wet or soft enough so that the particles therein can be moved and rotated (i.e. while the optically variable composition is in a first state), the optically variable composition may be subjected to a magnetic orientation, i.e. the optically variable composition may be subjected to a magnetic field to achieve orientation of the particles. The magnetically orienting of the particles comprises exposing the applied optically variable composition, while it is "wet" (i.e. still liquid and not too viscous, that is, in a first state), to a determined magnetic field generated by the magnetic-field-generating device, thereby orienting the particles along the field lines of the magnetic field such as to form an orientation pattern.

The exposing the optically variable composition comprising the optically variable pigments selected from the group consisting of magnetic thin film interference pigments interference coated pigment particles comprising a magnetic material and mixtures thereof to a magnetic field can be performed either partially simultaneously or simultaneously with the applying of the optically variable composition or subsequently thereto. That is, both procedures may be performed partially simultaneously or simultaneously or subsequently.

The process for producing the security thread or stripe described herein comprising the optically variable composition comprising the optically variable pigments selected from the group consisting of magnetic thin film interference pigments, interference coated pigment particles comprising a magnetic material and mixtures thereof, comprises, partially simultaneously with the magnetic orienting or subsequently to the magnetic orienting, a hardening such as described hereabove the optically variable composition so as to fix the particles in their adopted positions and orientations in a desired pattern, thereby transforming the optically variable composition to a second state. By this fixing, a solid optically variable layer is formed.

When the optically variable composition comprising the optically variable pigments selected from the group consisting of magnetic thin film interference pigments, interference coated pigment particles comprising a magnetic material and mixtures thereof is subjected to an orientation so as to orient the pigments described herein, it is particularly preferred to harden said optically variable composition by radiation curing and more preferably by UV-Vis light radiation curing, since these technologies advantageously lead to very fast curing processes and hence drastically decrease the preparation time of the security thread described herein. Moreover, radiation curing has the advantage of producing an almost instantaneous increase in viscosity of the optically variable composition after exposure to the curing radiation, thus minimizing any further movement of the particles The process for producing the security thread or stripe described herein may further comprise applying, preferably by a printing process, one or more protective varnishes so as to form one or more protective layers on the holographic metallic layer and/or on the opposite side of the transparent substrate (i.e. on the side facing the optically variable layer and/or the color constant layer), which is carried out after b).

The process for producing the security thread or stripe described herein may further comprise applying one or more additional transparent substrates on the structure obtained under b) described herein.

The process for producing the security thread or stripe described herein invention may further comprise applying one or more adhesive layers, preferably one or more thermoadhesive layers, on one or both sides of the structure obtained under b) or c) described herein. Applying one or more adhesive layers, preferably one or more thermoadhesive layers, on one or both sides of the structure obtained under b) or c) described herein provides adherence to a security document upon incorporation of the thread or stripe into or onto said security document.

Alternatively, security threads or stripes described herein comprising one or more additional transparent substrates such as those described hereabove may be prepared by laminating a) a first structure comprising the substrate described herein and the holographic metallic layer described herein with b) a second structure comprising the one or more transparent substrates described herein, the optically variable layer and the color constant layer, the optically variable layer and the color constant layer being prepared as described hereabove so that the optically variable layer and the color constant layer are comprised between the transparent substrate and the one or more transparent substrate and wherein the holographic metallic layer faces the environment. Alternatively, security threads or stripes described herein comprising one or more additional transparent substrates such as those described hereabove may be prepared by laminating a) a first structure comprising the substrate described herein and the optically variable layer and the color constant layer described herein with b) a second structure comprising the one or more transparent substrates described herein and the holographic metallic layer so that the holographic metallic layer is comprised between the transparent substrate and the one or more transparent substrate. Lamination may be performed by a conventional lamination process known in the art such as for example a processes consisting of applying heat and/or pressure on the first and second structures optionally further comprising an additional material present at least one of the surface to be bonded. Typically, the additional material consists of a conventional lamination adhesive layer or a conventional tie layer which may be water-based, solvent-based, solvent-free or UV-curable compositions. In an embodiment, the process comprises applying one or more adhesive layers on the first structure and/or on the second structure to adhere the first and second structures together in the laminated structure.

A further part of the method includes slicing the security threads or stripes described herein may be achieved so as to provide security threads or stripes having preferably a width, i.e. dimension in the transverse direction, between about 0.5 mm and about 30 mm, more preferably between about 0.5 mm and about 5 mm. When applying one or more adhesive layers, preferably one or more thermoadhesive layers, on one or both sides of the structure obtained under b) or d) described herein is performed, the slicing of the structure is carried out subsequently to the applying one or more adhesive layers.

The security threads or stripes described herein are particularly suitable for the protection of a security document against counterfeiting, fraud or illegal reproduction. Also described herein are security documents comprising said security threads or stripes. For example, the security document comprises the optically variable layer and/or the color constant layer, as the case may be, facing the environment and the substrate, the holographic metallic layer facing the substrate (4) and facing the security document, while the optically variable layer, the color constant layer and the holographic metallic layer are at least partially jointly visible from at least one side of the security thread or stripe, preferably at least partially jointly visible from the side of the security thread or stripe carrying the optically variable layer and/or the color constant layer. Alternatively and when the holographic metallic layer described herein comprises one or more demetalized areas, the optically variable layer and/or the color constant layer, as the case may be, may face the environment and faces the security document, the holographic metallic layer faces the environment, while the optically variable layer, the color constant layer and the holographic metallic layer are at least partially jointly visible from at least one side of the security thread or stripe, preferably at least partially jointly visible from the side of the security thread or stripe carrying the holographic metallic layer and/or the from the side of the security thread or stripe carrying the optically variable layer and/or the color constant layer The security thread or stripe described herein is at least partially embedded in the security document or the security thread or stripe described herein is mounted on the surface of the security document.

Security documents are usually protected by several security features which are chosen from different technology fields, manufactured by different suppliers, and embodied in different constituting parts of the security document. To break the protection of the security document, the counterfeiter would need to obtain all of the implied materials and to get access to all of the required processing technology, which is a hardly achievable task. Examples of security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, bank cards, credit cards, transactions cards, access documents, entrance tickets and the like. The term "value commercial good" refers to packaging material, in particular for pharmaceutical, cosmetics, electronics or food industry that may comprise one or more security features in order to warrant the content of the packaging like for instance genuine drugs. Example of these packaging material include without limitation labels such as authentication brand labels, tamper evidence labels and seals. Preferably, the security document described herein is selected from the group consisting of banknotes, identity documents such as passports, identity cards, driving licenses and the like and more preferably banknotes.

With the aim of increasing the wear and soil resistance or with the aim of modifying the optical gloss or aesthetic appearance of the security document described herein, the security document described herein may further comprise one or more protective layers.

Also described herein are processes for producing a security document comprising the security thread or stripe described herein and security documents obtained thereof. The processes for producing a security document comprising the security thread or stripe described herein comprising i) producing the security thread or stripe described herein, preferably by the process described herein and ii) at least partially embedding in said security document the security thread or stripe obtained under i) or mounting the security thread or stripe obtained under i) on the surface of the security document.

As mentioned hereabove, the security thread or stripe described herein may be at least partially embedded into the security document as a windowed security thread or stripe so that said security thread or stripe is at least partially visible from one side of the security document. When the security document comprises a substrate being a security paper, the security thread or stripe described herein may be at least partially embedded incorporated in the security paper during manufacture by techniques commonly employed in the paper-making industry. For example, the security thread or stripe described herein may be pressed within wet paper fibers while the fibers are unconsolidated and pliable, thus resulting in the security thread or stripe being totally embedded in the resulting security paper. The security thread or stripe described herein may also be fed into a cylinder mold papermaking machine, cylinder vat machine, or similar machine of known type, resulting in partial embedment of the security thread or stripe within the body of the finished paper (i.e. windowed paper).

Alternatively, the security thread or stripe described herein may be disposed completely on the surface of the security document as a transfer element. In such as case, the security thread or stripe described herein may be mounted on the surface of the security document by any known techniques including without limitation applying a pressure-sensitive adhesive to a surface of the security thread or stripe, applying a heat activated adhesive to a surface of the security thread or stripe or using thermal transfer techniques.

The invention claimed is:

1. A security thread or stripe comprising:

a) an optically variable layer which imparts different color impressions at different viewing angles, comprising an optically variable composition that comprises about 2 to about 40 wt-% of optically variable pigments, and said optically variable layer including indicia formed at least one of:

by one or more gaps in the optically variable composition; and with the optically variable composition, the weight percents being based on the total weight of the optically variable composition;

b) a color constant layer, which exhibits a color matching a color impression of the optically variable layer at a prescribed viewing angle, comprising a color constant composition that comprises at least one of about 1 to about 20 wt-% of one or more dyes and about 0.1 to about 45 wt-% of inorganic pigments, organic pigments or mixtures thereof, and said color constant layer including indicia formed at least one of:

by one or more gaps in the color constant composition; and with the color constant composition, the weight percents being based on the total weight of the color constant composition;

c) a holographic metallic layer; and d) a transparent substrate, wherein i) the holographic metallic layer faces an external environment and the transparent substrate and is located on an opposite side of the substrate carrying the color constant layer and the optically variable layer and ii) at least one of the color constant layer and/or the optically variable layer faces the environment, wherein the optically variable layer, the color constant layer and the holographic metallic layer are at least partially jointly visible from at least one side of the security thread or stripe, and wherein the indicia are independently selected from the group consisting of symbols, alphanumeric symbols, motifs, geometric patterns, letters, words, numbers, logos, drawings and combinations thereof.

2. The security thread or stripe according to claim 1, wherein the optically variable layer is arranged on top of the color constant layer.

3. The security thread or stripe according to claim 1, wherein the color constant layer is arranged on top of the optically variable layer.

4. The security thread or stripe according to claim 1, wherein the optically variable layer is arranged adjacent to the color constant layer.

5. The security thread or stripe according to claim 1, wherein the transparent substrate is made of one or more plastics or polymers.

6. The security thread or stripe according to claim 1, wherein the optically variable pigments are selected from the group consisting of thin film interference pigments, magnetic thin film interference pigments, interference coated pigments, interference coated pigment particles comprising a magnetic material, and mixtures thereof.

7. The security thread or stripe according to claim 1 further comprising at least one of one or more protective layers and one or more additional transparent substrates made of one or more plastics or polymers.

8. The security thread or stripe according claim 7, at least of:

wherein the at least one of the one or more protective layers and the one or more additional transparent substrates are arranged to face the holographic metallic layer and to face the external environment; and wherein that at least one of the one or more protective layers and the one or more additional transparent substrates are arranged to face at least one of the optically variable layer and the color constant layer and to face the external environment.

9. The security thread or stripe according to claim 7, wherein the one or more plastics or polymers are independently selected form the group consisting of polyolefins, polyamides, polyesters, polyvinylchlorides and mixtures thereof.

10. The security thread or stripe according to claim 1 further comprising one or more additional layers selected from the group consisting of adhesive layers, lacquers, machine readable layers, hiding layers and combinations thereof.

11. A process for making the security thread or stripe recited in claim 1 comprising:

forming a first structure by one of:

applying the color constant composition onto a side of the transparent substrate opposite a holographic metallic layer carrying side of the transparent substrate by a process selected from the group consisting of offset, rotogravure, screen printing, flexography and combinations thereof to produce the color constant layer with indicia formed at least one of:

by one or more gaps in the color constant composition; and with the color constant composition in the form of indicia hardening said color constant composition; and applying the optically variable composition on the side of the substrate carrying the color constant layer by a process selected from the group consisting of rotogravure, screen printing, flexography and combinations thereof to produce the optically variable layer with indicia formed at least one of:

by one or more gaps in the optically variable composition; and with the optically variable composition; and hardening said optically variable composition, or applying the optically variable composition onto a side of the transparent substrate opposite a holographic metallic layer carrying side of the transparent substrate by a process selected from the group consisting of rotogravure, screen printing, flexography and combinations thereof to produce the optically variable layer with indicia formed at least one of:

by one or more gaps in the optically variable composition; and with the optically variable composition;

hardening said optically variable composition; and applying the color constant composition on the side of the substrate carrying the optically variable layer by a process selected from the group consisting of offset, rotogravure, screen printing, flexography and combinations thereof to produce a color constant layer with indicia formed at least one of:

by one or more gaps in the color constant composition; and with the color constant composition; and hardening said color constant composition, and wherein the indicia are independently selected from the group consisting of symbols, alphanumeric symbols, motifs, geometric patterns, letters, words, numbers, logos, drawings and combinations thereof.

12. The process recited in claim 11, further comprising at least one of:

applying one or more additional transparent substrates on the first structure; and applying one or more protective varnishes so as to form one or more protective layers.

13. The process recited in claim 12, further comprising applying one or more thermoadhesive layers on the at least one of the additional transparent substrates and the protective layers.

14. The process recited in claim 11, further comprising applying one or thermoadhesive layers on one or both sides of the first structure.

15. A process for making a security thread or stripe recited in claim 1 comprising:

laminating the first structure with a second structure comprising one or more additional transparent substrates, wherein the optically variable layer and the color constant layer are located between the transparent substrate and at least one of the one or more additional transparent substrates, and wherein the holographic metallic layer faces the external environment.

16. A process for protecting a security document against counterfeiting, fraud or illegal reproduction comprising: applying the security thread or stripe recited in claim 1 to a security document to be protected.

17. A security document comprising the security thread or stripe recited in claim 1.

18. A process for producing the security document recited in claim 17, comprising:

i) producing the security thread or stripe, and ii) at least partially embedding in said security document the security thread or stripe obtained under step a) or mounting the security thread or stripe obtained under step a) on the surface of the security document.

19. The security thread or stripe of claim 5, wherein the one or more plastics or polymers are selected form the group consisting of polyolefins, polyamides, polyesters, polyvinylchlorides and mixtures thereof.

* * * * *